US009498676B1

(12) United States Patent
Emick

(10) Patent No.: US 9,498,676 B1
(45) Date of Patent: Nov. 22, 2016

(54) HANDLE MECHANISM FOR SQUAT PLATE LIFTING

(71) Applicant: Daniel W. Emick, Montoursville, PA (US)

(72) Inventor: Daniel W. Emick, Montoursville, PA (US)

( * ) Notice: Subject to any disclaimer, the term of this patent is extended or adjusted under 35 U.S.C. 154(b) by 0 days.

(21) Appl. No.: 14/756,222

(22) Filed: Aug. 18, 2015

(51) Int. Cl.

| | |
|---|---|
| ***A63B 71/00*** | (2006.01) |
| ***A63B 23/04*** | (2006.01) |
| ***A63B 21/062*** | (2006.01) |
| ***A63B 21/072*** | (2006.01) |

(52) U.S. Cl.
CPC ..... *A63B 23/04* (2013.01); *A63B 21/062* (2013.01); *A63B 21/072* (2013.01); *A63B 21/4033* (2015.10); *A63B 2023/0411* (2013.01)

(58) Field of Classification Search
CPC ..... A63B 21/072–21/075; A63B 21/4035; A63B 21/06; A63B 21/0004; A63B 21/062; A63B 21/0624; A63B 21/0626; A63B 21/159; A63B 23/21; A63F 5/10; A63F 2005/1006; B62B 5/067; B25G 1/005; B25G 1/04; B25G 1/043; B25G 1/066; B62K 21/12; B62K 21/125; B62K 21/16; Y10T 16/466; Y10T 16/469; Y10T 16/4713; Y10T 16/473
USPC ..... 294/164
See application file for complete search history.

(56) References Cited

U.S. PATENT DOCUMENTS

| | | | | | |
|---|---|---|---|---|---|
| 4,717,147 | A * | 1/1988 | Rochelle | A63B 21/0724 | 294/15 |
| 5,209,481 | A * | 5/1993 | DeBack | A63B 21/0004 | 473/220 |
| 5,496,240 | A * | 3/1996 | Damm | A63B 21/072 | 482/93 |
| 5,695,436 | A * | 12/1997 | Huang | A63B 21/0004 | 482/121 |
| 5,827,157 | A * | 10/1998 | Lee | A63B 21/06 | 482/93 |
| D416,959 | S * | 11/1999 | Tumminia | D21/662 | |
| 6,030,323 | A * | 2/2000 | Fontenot | A63B 21/0083 | 482/111 |
| 6,301,749 | B1 * | 10/2001 | Chen | B62K 3/002 | 16/427 |
| 6,689,022 | B1 * | 2/2004 | Emick | A63B 21/06 | 482/93 |
| 7,476,183 | B1 * | 1/2009 | Chrest | A63B 21/072 | 482/908 |
| D653,715 | S * | 2/2012 | Tumminia | D21/662 | |
| 2010/0029447 | A1 * | 2/2010 | Song | A63B 21/06 | 482/93 |

(Continued)

OTHER PUBLICATIONS

Website http://musclemaxx.net.

(Continued)

*Primary Examiner* — Loan H Thanh
*Assistant Examiner* — Gregory Winter
(74) *Attorney, Agent, or Firm* — Thomas R. Shaffer

(57) ABSTRACT

A handle mechanism for squat plate lifting includes a weight holding member having a base plate adapted to receive one or more annular free weight plates. The handle mechanism includes a vertical riser tube having pairs of lock tab holes on opposite sides of the tube at a plurality of vertical locations. A lifting mechanism includes a sleeve member sized and configured to slide vertically up and down on the vertical riser tube and to be removable therefrom. A pair of handles are pivotally attached to opposite sides of the sleeve member and include a locking plate member with a locking tab attached to each handle. A user can quickly and easily slide the lifting mechanism onto the weight holding member with the handles in a lowered position and, when the handles are lifted to an uppermost horizontal position, the locking tab of each locking plate member locks into the riser tube allowing the handles to lift the entire handle mechanism. With this arrangement, without letting go of the handles, a user can successively change and lift various weight holding members of various weights.

11 Claims, 7 Drawing Sheets

(56) References Cited

U.S. PATENT DOCUMENTS

2014/0057764 A1* 2/2014 Klukas ..... A63B 15/00
482/109
2015/0033904 A1* 2/2015 Chu ..... B62K 21/16
74/551.4
2015/0174445 A1* 6/2015 Robertson, Jr. .... A63B 23/0405
482/93

OTHER PUBLICATIONS

Website http://power-systems.com.

* cited by examiner

HANDLE MECHANISM FOR SQUAT PLATE LIFTING

BACKGROUND OF THE INVENTION

1. Field of the Invention

The present invention relates to a handle mechanism for squat plate lifting. More specifically it relates to a unique lifting means including a pair of pivotally mounted handles which can be easily removed from one weight holding member and attached to a second or third etc. weight holing member, each weight holding member having differing weight plates thereon.

2. Description of the Prior Art

A wide stance squat or dead lift exercise is a resistance exercise that, for best results, require that weightlifters progressively increase resistance placed against targeted muscles in order to realize conditioning effects. In the case of wide stance squat/dead lift exercises, the primary targeted muscles are the legs, and more specifically the gluteus, quadriceps and adductors. Of these, the buttocks and inner thigh training effect is greatly enhanced through use of an exaggerated (wider than shoulders) foot stance width.

To perform this exercise, the weightlifter loads provides proper resistance (weights), assumes a desired foot span, and from a standing position, bends his/her knees and squats. Once the lower most range of motion is obtained, the weightlifter then presses his/her body upward with legs and repeats. This exercise is an effective means of targeting the lower body muscle groups while simultaneously minimizing knee and lumbar injury risks, when properly performed with well designed exercise equipment.

The use of "free-weights" (non-machine types) as means of resistance loading for the body for a wide stance squat/dead lift exercise is well known with both barbells and dumbbells. In the case of barbell loading for squats, this is accomplished when a user places the barbell horizontally across the upper back, resting on rear shoulders, and directly over spine. As for barbell dead lift resistance loading, the user squats to meet the horizontally opposed bar at floor level, grasps bar with arms reaching downward, then drives the body upward with his/her legs as the barbell is pulled from the floor to uppermost range of motion (standing erect). Regarding dumbbells, they can be used in pairs for squats by simply holding at sides (one in each hand) on down stretched arms. A single dumbbell can also be used by holding it vertically with both hands in front and center of the weightlifter's body.

A common drawback to the use of such free weights are risks associated with placing loaded barbells directly over one's spine (barbell wide stance), or those encountered during barbell dead lifts as weightlifters rises from squatted position, and barbell travels outward from body to "clear" knees at the midpoint of the lift. This commonly causes abrasions to shins and knees and can seriously injure the spine as bar moves forward and away from body's centerline, thereby increasing lumbar spinal load dramatically. Of lesser note is the fact that single dumbbell loading can place limitations on exercise movement's range of motion due to premature contact with floor, when using heavier (longer) dumbbells. This situation may occur as well with shorter body types.

There are some existing devices which provide some improvements to the traditional barbell and dumbbell resistance loading for this exercise. Variously configured bars have been proposed to better accommodate weightlifters bodies. Such is the case with devices know as super dead lift and hexagonal bars. These "U" and hexagon shaped bars place users inside and holding on with down stretched arms, thereby reducing shin/knee bar conflict, lumbar risks, and range of motion issues common to barbell/dumbbell usage.

A primary drawback to super dead lift and hexagonal bars is the fact that user's leg length and body size may hinder protective benefits due to the bar limiting how far apart a user's feet may be (narrower foot stance places more stress on lumbar spine and knees). Additionally, the sheer size, weight and cumbersomeness of these super dead lift and hexagonal bars often prevent smaller users from utilizing them. Furthermore since these dead lift bars weigh in at over 45 pounds, excessive shipping costs further impede their overall practicality and popularity.

SUMMARY OF THE INVENTION

The present invention overcomes all drawbacks associated with prior art devices regarding the performance of wide stance squat and dead lift exercises. For starters, the weight holding member of the present invention may be rolled to weight plate and dumbbell storage stands for easy loading and unloading, then rolled into desired exercise locations with ease. This negates the cumbersome act of lugging weight plates across a crowded gym to the exercise area and barbell/squatting device locations. Additionally the present invention provides a novel "quick release" lifting means including a pair of handles which serves to further facilitate ease of use by providing for rapid and convenient plate changes uncommon to prior art offerings. Further, the handles of the present invention are rubberized and allow weightlifters' hands to be in the preferred neutral wrist, palms facing body position for optimal gripping power and comfort. Furthermore, the present invention's novel design also eliminates bar to knee/shin conflicts which are common to prior art barbell dead lifts. Another valuable feature of the present invention is its non intimidating size and weight which ensures accessibility of use regardless of weightlifters size or strength levels. This is not the case with prior art barbells or other known squatting devices, which typically weigh in at 45+ pounds and thereby present a negative effect on one's ability to purchase due to exorbitant shipping costs.

In its simplest form, the present invention provides a handle mechanism for squat plate lifting comprising:

a) a weight holding member, said weight holding member having a base plate adapted to receive one or more annular free weight plates; and said weight holding member having a vertical riser tube having a first lower end thereof attached to said base plate and having a second upper end thereof located above said base plate, said riser tube having pairs of lock tab holes on opposite sides of the tube at a plurality of vertical locations between said lower end and said upper end of said riser tube; and b) a lifting means, said lifting means having a sleeve member sized and configured to slide vertically up and down on said vertical riser tube and to be removable therefrom; said lifting means also having a pair of handles pivotally attached to opposite sides of said sleeve member; said lifting means also having a locking plate member with locking tab attached to each handle whereby a user gripping said handles of the lifting means can quickly and easily slide the lifting means onto the weight holding member with said handles is a lowered position and, when the handles are lifted to and uppermost horizontal position, said locking tab of each locking plate member enters a desired lock tab hole in said vertical riser tube, said locking tabs gripping said vertical riser tube allowing said handles to lift the entire handle mechanism including the weight holding member, any free weights placed thereon and said lifting means and whereby when said entire handle mechanism is set upon a flat surface and the handles are pushed downwardly, said locking tabs exit said lock tab holes allowing the lifting means to be lifted vertically and removed from the weight holding member.

Preferably, the riser tube has a square cross sectional configuration and has lock tab holes on all four sides the tube at a plurality of vertical locations between said lower end and said upper end of said riser tube.

Preferably, the weight holding member also has a plurality of wheels mounted to an underside thereof to allow said weigh holding member to be rolled to a desired location on a floor.

Preferably, the sleeve member further comprises a body portion and upper end portion, said upper end portion having a pair of attachment ears on opposite sides thereof.

Preferably, the lifting means further comprises a hinge tube attached to each said locking plate member and a pair of hinge pins, each hinge pin connecting a handle to said sleeve member, whereby said handles may move upwardly and downwardly in a arc around said hinge pins.

Preferably, the lifting means may be easily removed from a first weight holder member and slid downwardly on a second weight holding member with different weight plates thereon.

Preferably, moving said lifting means from a first weight holder member to a second holder member can be achieved in one fluid motion of a user's hands with a user's left hand moving first upwardly (to remove from first weight holding means) then downwardly (to place on second weight holder means) along a "J" path and a user's right hand moving first upwardly and then downwardly along a backward "J" path.

Preferably, the locking plate member is mounted at an angle A relative to a center axis of said handle which between 130 degrees and 150 degrees and preferably, approximately 140 degrees.

Preferably, each of said handles is covered with a rubberized handle sleeve.

DETAILED DESCRIPTION OF THE PREFERRED EMBODIMENTS

Figure 1:
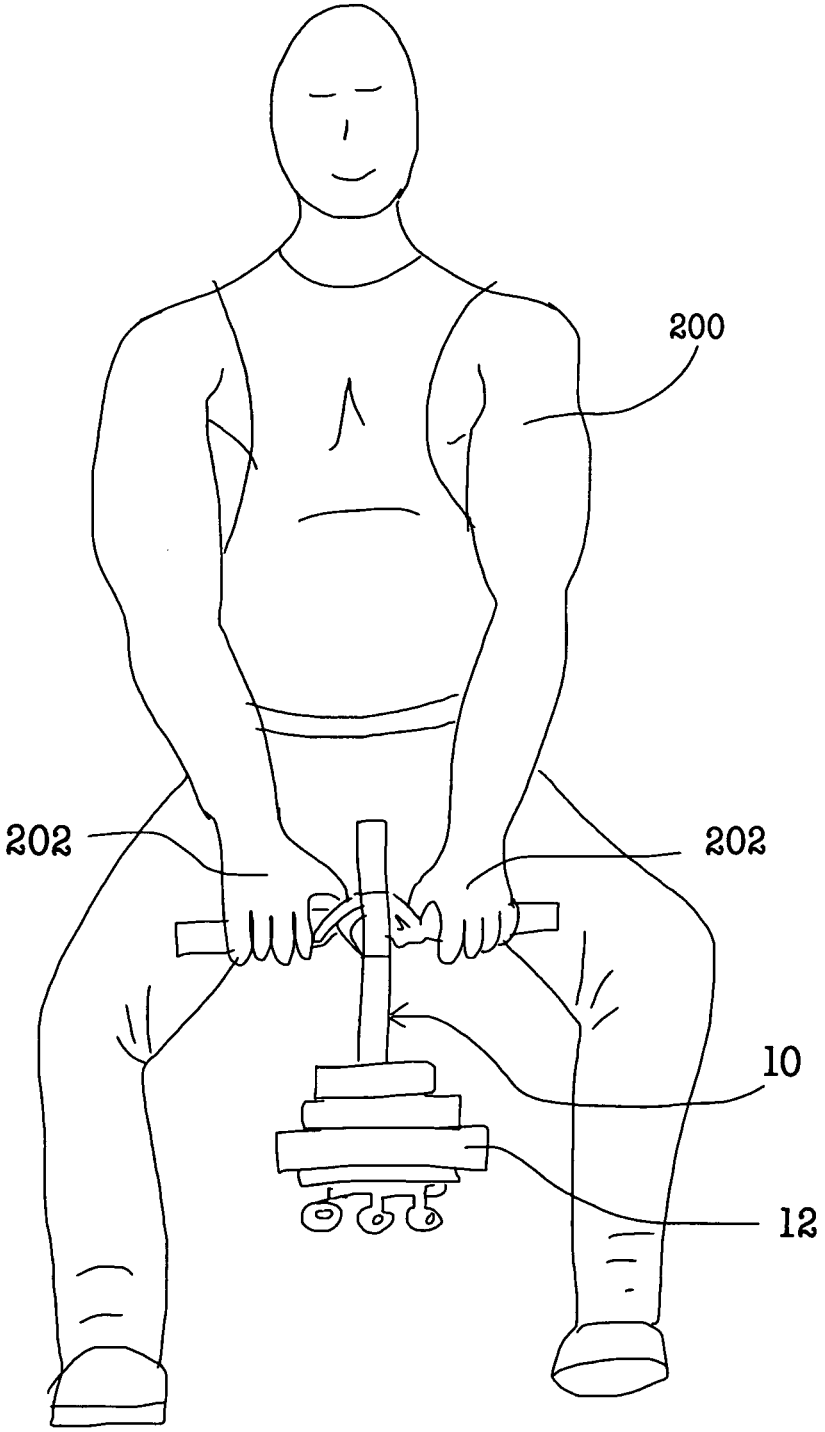
FIG. 1 is a front view of a weightlifter forming a widestance squat/dead lift exercise utilizing the handle mechanism of the present invention.

Referring to FIG. 1, a weightlifter 200 is shown lifting a handle mechanism 10 of the present invention while performing a widestance squat (otherwise known as a deadlift exercise). As can be seen, user's hands 202 are utilized to grip handles on the handle lift mechanism 10 in order to lift a desired number and weight of weight plates 12.

Figure 2:
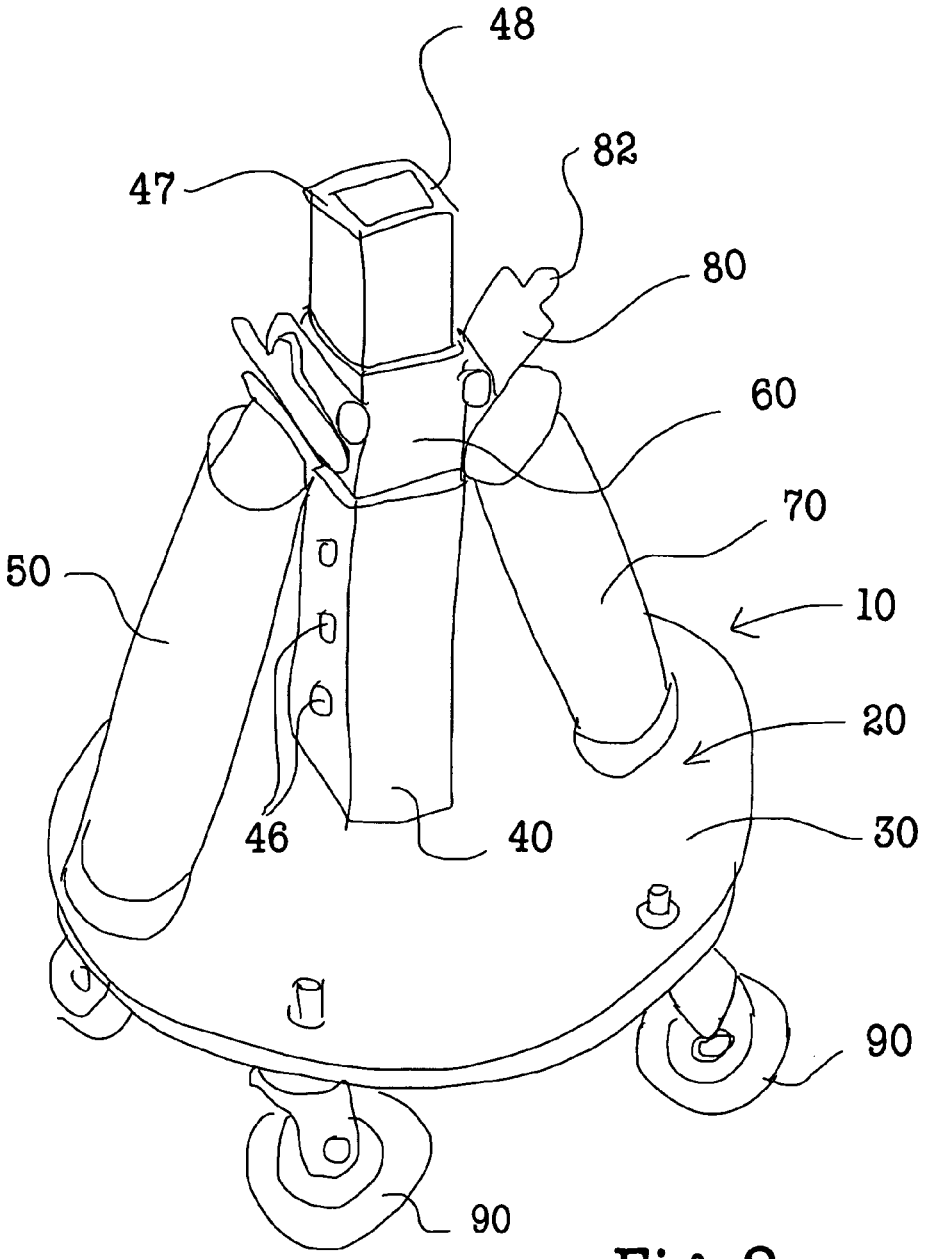
FIG. 2 is a perspective view of a handle mechanism of the present invention with the handles in a lowered position.
Figure 3:
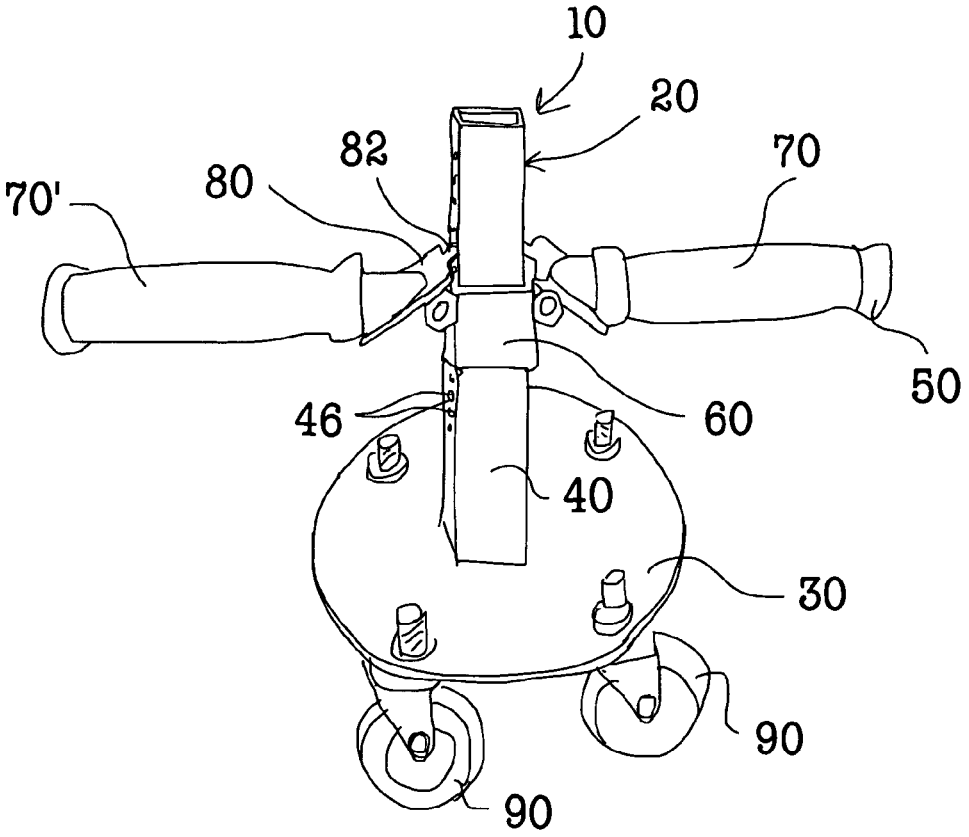
FIG. 3 is a perspective view of the handle mechanism of the present invention with the handles in a locked upward position.
Figure 4:
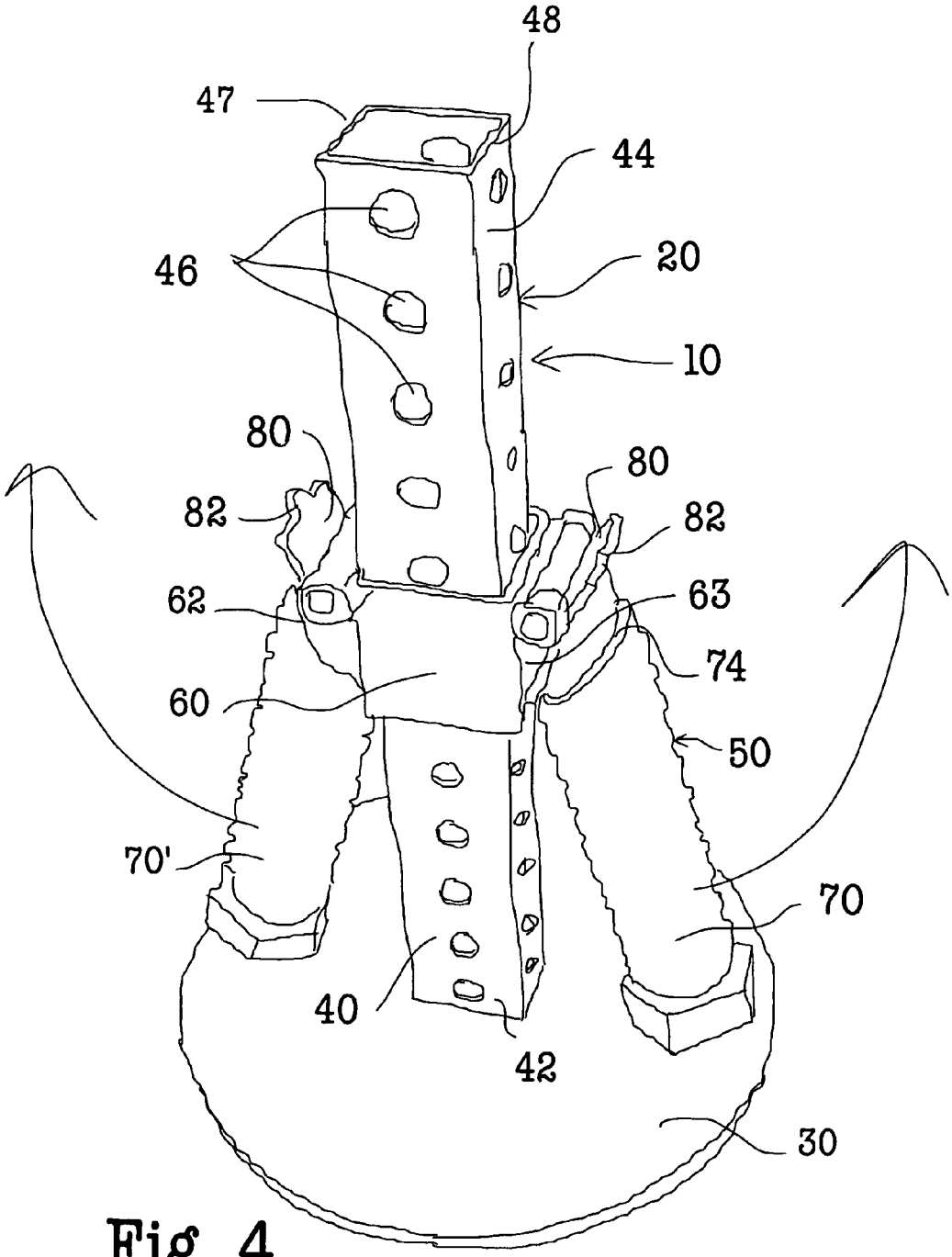
FIG. 4 is a perspective view showing details of the invention and the direction of the motion of the handles relative to the sleeve member.

Referring to FIGS. 2-6, the handle mechanism 10 includes a weight holding member 20 which includes a baseplate 30 adapted to receive one or more weight plates 12 (see FIG. 1). The weight holding member 20 has a vertical riser tube 40 which has a first lower end 42 and a second upper end 44 (FIG. 4). The riser tube 40 has lock tab holes 46 on opposite sides 47, 48 of the riser tube 40 in a plurality of vertical locations between said lower end 42 and said upper end 44 of the riser tube 40.

Figure 5:
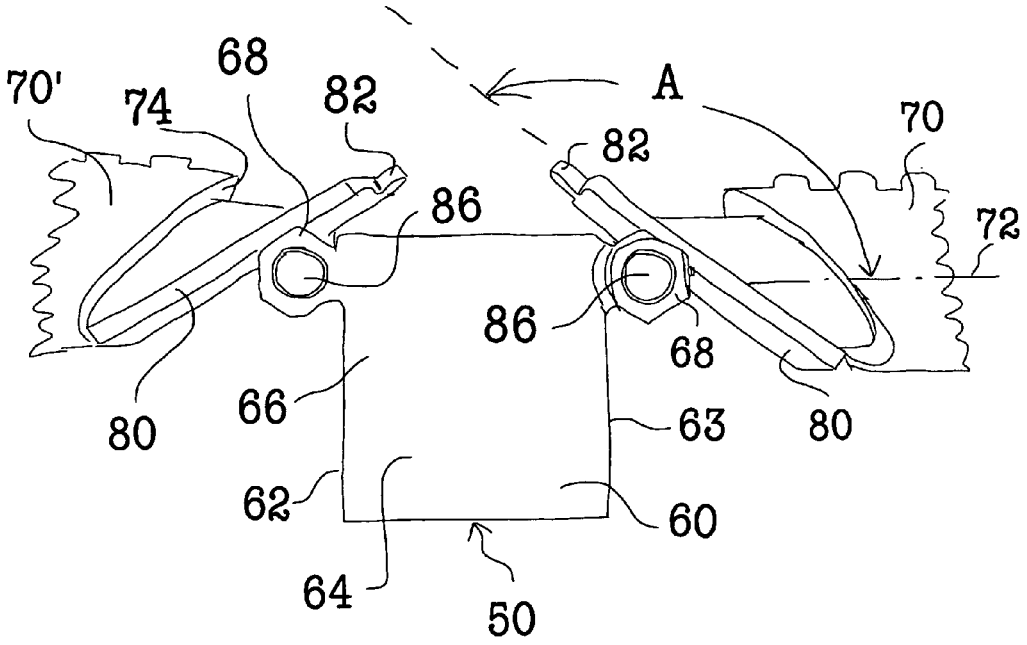
FIG. 5 is a front perspective view showing the lifting means of the present invention.
Figure 6:
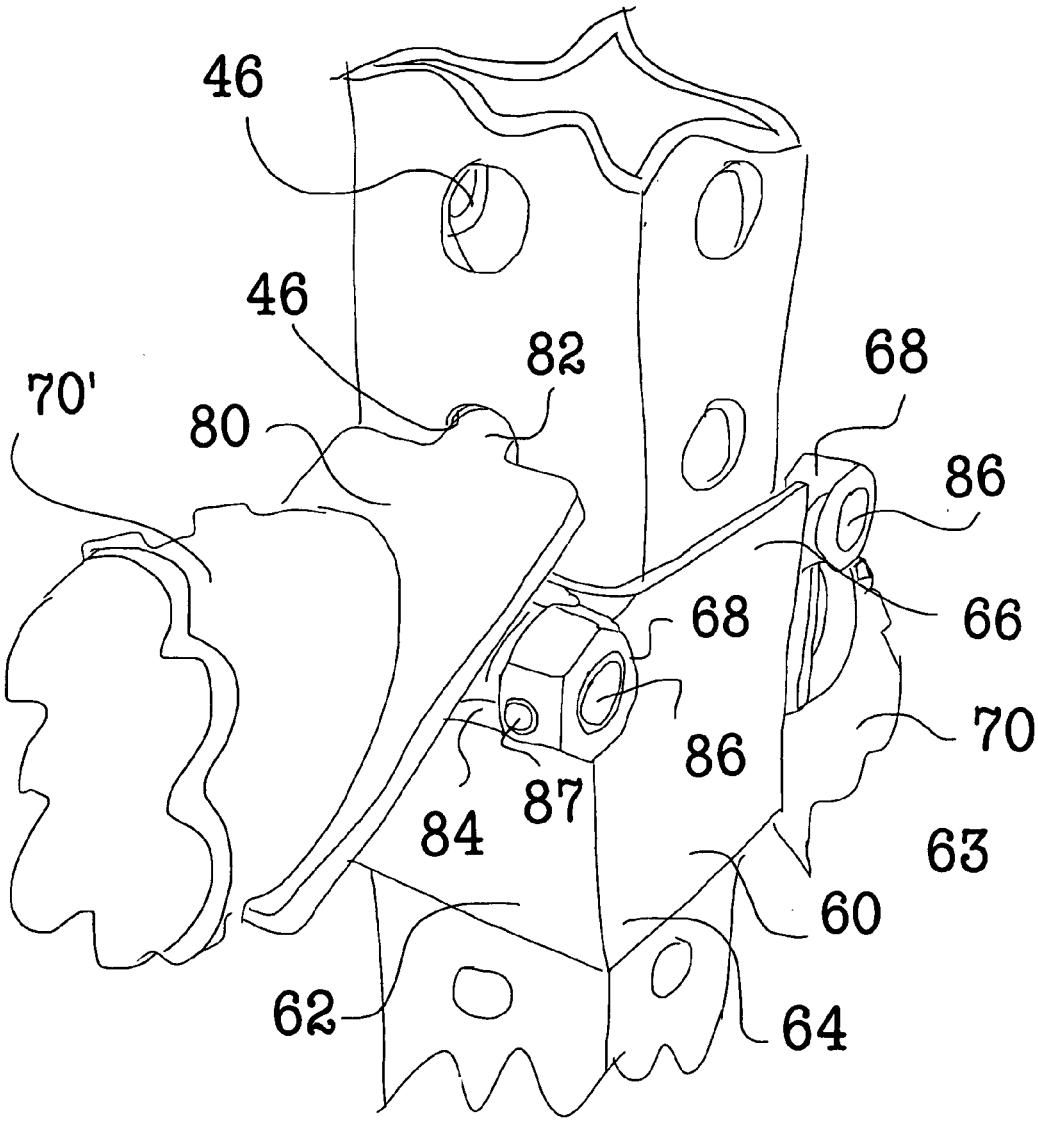
FIG. 6 is a perspective view showing the locking plate member and lock tab as locked into the lock tab holes of the vertical riser tube.

A lifting means 50 is provided which has a sleeve member 60 sized and configured to slide vertically up and down on the vertical riser tube 40 and to be easily removable there from. The lifting means 50 also has a pair of handles 70 and 70' which are pivotally attached to opposite sides, 62 and 63 of the sleeve member 60 (FIG. 5). Lifting means 50 also includes a lock plate member 80 which has a protruding lock tab 82 attached to each handle 70, 71 whereby a user gripping the handles of the lifting means 50 can quickly an easily slide the lifting means 50 onto the weight holding member 20 with the handles in a lowered position as shown in FIG. 2 and, when the handles are lifted to an uppermost horizontal position, as shown in FIG. 3, the locking tab 82 of each locking plate member 80 enters a desired locked tab holes 46 in said vertical riser tube 40. This is best shown in FIG. 6. The locking tabs 82 grip the vertical riser tube 40 allowing the handle 70, 70' to lift the entire handle mechanism 10 including the weight holding member 20 any free weight plates 12 thereon and said lifting means 50 whereby when the entire handle mechanism 10 is set upon a flat surface and the handles are pushed downwardly the locking tabs 82 exit said locked tab holes 46 allowing the lifting means 50 to be lifted vertically and removed from the weight holder member 20.

Figure 7:
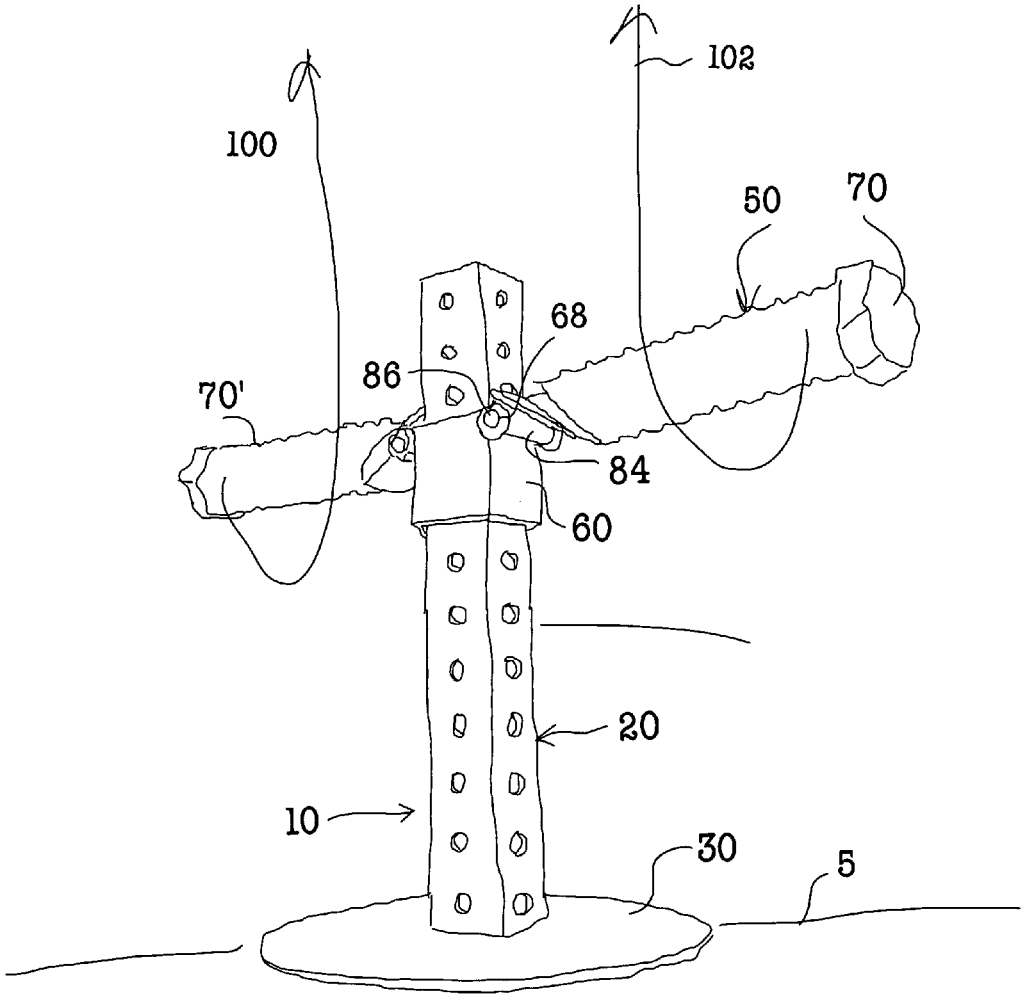
FIG. 7 is a perspective view of the handle mechanism of the present invention showing the location and motion of user's hands necessary to vertically remove the lifting means from the weight holding member.

While the riser tube 40 includes lock tab holes 46 on opposite sides 47 and 48 of the riser tube 40 at a plurality of vertical locations as shown in FIGS. 2 and 3, it is preferable that the riser tube 40 has a square cross sectional configuration and has lock tab holes 46 on all four sides of the riser tube 40 shown in FIGS. 4, 6 and 7. This provides greater flexibility for the user who can then just slide the lifting means 50 onto a vertical riser tube 40 without regard to its orientation.

As shown in FIGS. 1, 2 and 3 the weight holding member 20 preferably includes a plurality of wheels 90 mounted to an underside thereof to allow the weight holding member 20 to be rolled to a desired location on a floor. This, for example, would allow a weightlifter to simply roll the handle mechanism 10 over to a weight rack, place the desired number of weight plates 12 onto the weight holding member 20 (after removing the lifting means 50).

While any hinge mechanism may be utilized to connect the handles 70 and 70' onto the sleeve member 60 of the lifting means 50, it is preferred that the sleeve member 60 include a body portion 64 which has an upper portion 66 on which a pair of attachment ears 68 are provided on opposite sides thereof. This is best shown in FIGS. 5 and 6.

The lifting means 50 further preferably comprises a hinged tube 84 which is attached to the locking weight member 80. A pair of hinge pins 86 are then utilized to pivotally mount the handles 70, 70' onto the sleeve member 60 whereby the handles may move upwardly and downwardly in an arc around said hinge pins 86. As shown in FIG. 6, a set screw 87 can be used to secure the hinge pins 86 across the attachment ears 68. This allows the hinge tube 84 to rotate relative to the hinge pin 86.

As indicated above the lifting mechanism 50 of the present invention may be easily removed from a first weight holder member 20 and slide downwardly onto a second weight holder member (not shown) with different weights thereon.

The act of removing the lifting means 50 from the first weight holder member 20 can be achieved in one fluid motion of the user's hands 202 with the user's left hand moving along a "J" path 100 and a user's right hand moving along a backward "J" path 102 as shown in FIG. 7. With this single fluid motion of the hands the entire lifting means 50 can be removed from the weight holder member 20. By a user performing the exact opposite motion (i.e. downwardly along the "J" paths), the lifting means 50 may be easily placed on any desired weight holding member having any desired weight to be lifted.

It is to be understood that while certain forms of the present invention have been illustrated and described herein, the present invention is not to be limited to the specific forms or arrangements of parts described and shown.

I claim:

1. A handle mechanism for squat plate lifting comprising:

a) a weight holding member, said weight holding member having a base plate adapted to receive one or more annular free weight plates; and said weight holding member having a vertical riser tube having a first lower end thereof attached to said base plate and having a second upper end thereof located above said base plate, said riser tube having pairs of lock tab holes on opposite sides of the tube at a plurality of vertical locations between said lower end and said upper end of said riser tube; and b) a lifting means, said lifting means having a sleeve member sized and configured to slide vertically up and down on said vertical riser tube and to be removable therefrom; said lifting means also having a pair of handles pivotally attached to opposite sides of said sleeve member; said lifting means also having a locking plate member with a locking tab attached to each handle whereby a user gripping said handles of the lifting means can quickly and easily slide the lifting means onto the weight holding member with said handles in a lowered position and, when the handles are lifted to an uppermost horizontal position, said locking tab of each locking plate member enters one of the lock tab holes in said vertical riser tube, said locking tabs gripping said vertical riser tube allowing said handles to lift the handle mechanism including the weight holding member, any free weights placed thereon and said lifting means and whereby when said handle mechanism is set upon a flat surface and the handles are pushed downwardly, said locking tabs exit said lock tab holes allowing the lifting means to be lifted vertically and removed from the weight holding member.

2. The handle mechanism according to claim 1 wherein said riser tube has a square cross sectional configuration and has lock tab holes on all four sides of the tube at a plurality of vertical locations between said lower end and said upper end of said riser tube.

3. The handle mechanism according to claim 1 wherein said weight holding member also has a plurality of wheels mounted to an underside thereof to allow said weight holding member to be rolled to a desired location on a floor.

4. The handle mechanism according to claim 1 wherein said sleeve member further comprises a body portion and upper end portion, an upper end portion having a pair of attachment ears on opposite sides thereof.

5. The handle mechanism according to claim 4 wherein said lifting means further comprises a hinge tube attached to each said locking plate member and a pair of hinge pins, each hinge pin connecting a respective handle to said sleeve member, whereby said handles may move upwardly and downwardly in an arc around said hinge pins.

6. The handle mechanism according to claim 1 whereby said lifting means may be easily removed from a first weight holder member and slid downwardly on a second weight holding member with different weight plates thereon.

7. The handle mechanism according to claim 6 wherein moving said lifting means from a first weight holder member to a second holder member can be achieved in one fluid motion of a user's hands with a user's left hand moving first upwardly then downwardly along a "J" path and a user's right hand moving first upwardly and then downwardly along a backward "J" path.

8. The handle mechanism according to claim 1 wherein said locking plate member is mounted at an angle A relative to a center axis of said handle.

9. The handle mechanism according to claim 8 wherein said angle A is between 130 degrees and 150 degrees.

10. The handle mechanism according to claim 8 wherein said angle A is approximately 140 degrees.

11. The handle mechanism according to claim 1 wherein each of said handles is covered with a rubberized handle sleeve.

* * * * *